United States Patent [19]

Bain et al.

[11] 4,018,664

[45] Apr. 19, 1977

[54] METHOD FOR REDUCING MINERAL CONTENT OF SLUDGE

[75] Inventors: Frederick A. Bain, Willowdale; John O. L. Roberts, Toronto, both of Canada

[73] Assignee: Great Canadian Oil Sands Limited, Toronto, Canada

[22] Filed: May 27, 1975

[21] Appl. No.: 580,852

[52] U.S. Cl. ..... 208/11 LE; 210/44; 210/83

[51] Int. Cl.[2] ..... C10G 1/04

[58] Field of Search ..... 208/11 LE; 210/44, 65, 210/83, 73 R

[56] References Cited

UNITED STATES PATENTS

| | | | |
|---|---|---|---|
| 3,502,565 | 3/1970 | Baillie | 208/11 LE |
| 3,526,585 | 9/1970 | Camp | 210/44 |
| 3,931,006 | 1/1976 | Baillie et al. | 210/83 |

*Primary Examiner*—Delbert E. Gantz
*Assistant Examiner*—James W. Hellwege
*Attorney, Agent, or Firm*—J. Edward Hess; Donald R. Johnson

[57] ABSTRACT

A process for treating retention pond sludge containing greater than 20% solids including minerals and bitumen and associated with the aqueous extraction of bitumen from tar sands to provide water substantially reduced in solids content which comprises agitating the sludge with water to provide a diluted sludge with a solids concentration in the range of 6 to 18% by weight, and thereafter settling the sludge to form a lower layer having a solids content substantially higher than that of the sludge an upper layer of bituminous froth, and a middle layer of water having a substantially lower solids content than said undiluted sludge and recovering said upper layer.

4 Claims, 1 Drawing Figure

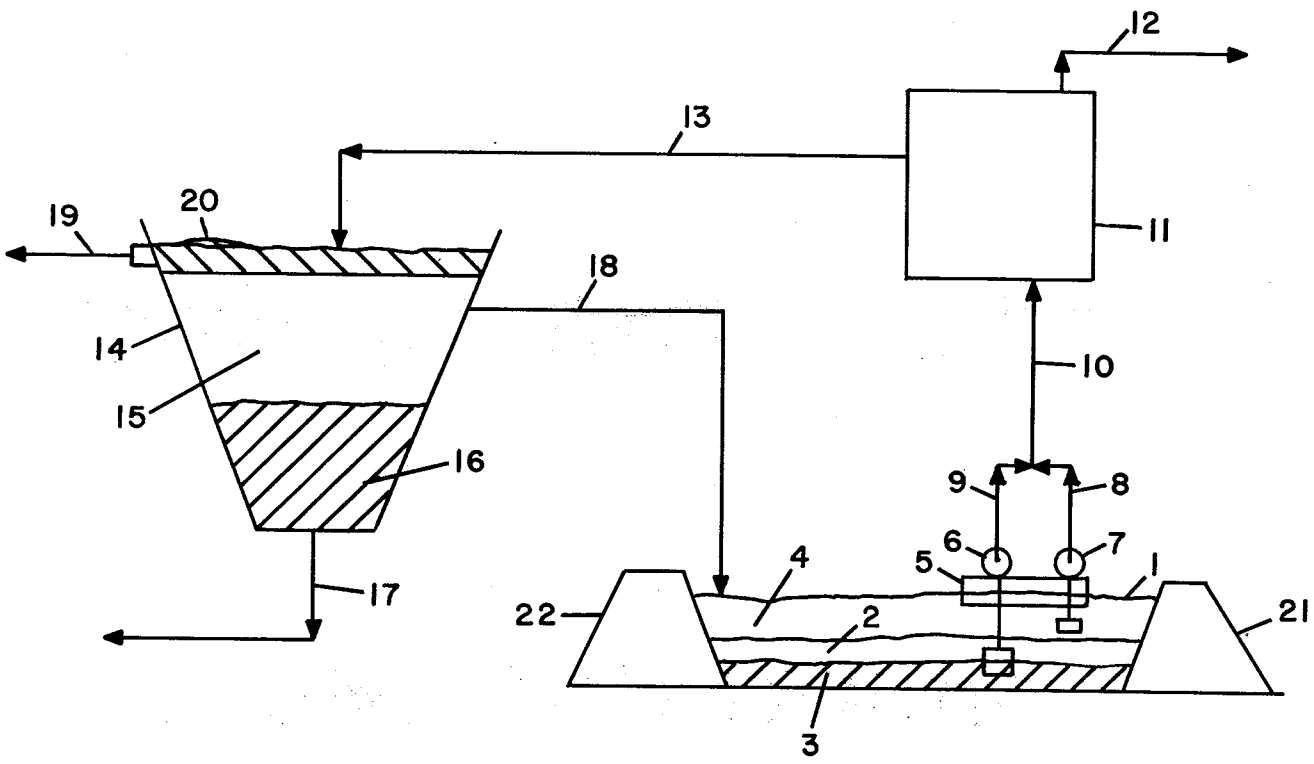
12
11
10
8
7
21
1
9
6
5
2
3
4
13
18
22
16
17
20
14
15
19

METHOD FOR REDUCING MINERAL CONTENT OF SLUDGE

CROSS REFERENCE TO RELATED APPLICATIONS

This application is related to our copending application Ser. No. 580,853, entitled "Method of Sludge Disposal Related to the Hot Water Extraction of Tar Sands" filed of even date herewith.

BACKGROUND OF THE INVENTION

The present invention relates to a method for reducing the solids content of a waste water retention pond associated with aqueous methods of extracting bitumen from tar sands.

Tar sands, which are also known as oil and bituminous sands, are siliceous materials which are impregnated with a heavy petroleum. The largest and most important deposits of the sands are the Athabasca sands, found in northern Alberta, Canada. These sands underlay more than 13,000 square miles at a depth of 0 to 2,000 feet. Total recoverable reserves after extraction and processing are estimated at more than 300 billion barrels. Tar sands are primarily silica, having closely associated therewith an oil film which varies from about 5 to 21 percent by weight, with a typical content of 13 weight percent of the sand. The oil is quite viscous – 6 to 10° API gravity — and contains typically 4.5% sulfur and 38% aromatics. In addition to the oil and sand components, tar sands contain clay and silt in quantities of from 1 to 50 weight percent, more usually 10 to 30%. The sands also contain a small amount of water, in quantities of 1 to 10% by weight, in the form of a film around the sand grains.

Several basic extraction methods have been known for many years for the separation of oil from the sands. In the so-called "cold water" method, the separation is accomplished by mixing the sands with a solvent capable of dissolving the bitumen constituent. The mixture is then introduced into a large volume of water, water with a surface agent added, or a solution of a neutral salt in water, which salt is capable of acting as an electrolyte. The combined mass is then subjected to a pressure or gravity separation.

In the hot water method, as disclosed in Canadian Pat. No. 841,581 issued May 12, 1970, the bituminous sands are jetted with steam and mulled with a minor amount of hot water at temperatures of 170° to 190° F., and the resulting pulp is then dropped into a turbulent stream of circulating hot water and carried to a separation cell maintained at a temperature of about 185° F. In the separation cell, sand settles to the bottom as tailings and oil rises to the top in the form of a froth. An aqueous middlings layer comprising clay and silt and some oil is formed between these layers. This basic process may be combined with a scavenger step for further treatment of the middlings layer obtained from the primary separation step to recover additional amounts of oil therefrom.

The middlings layer, either as it is recovered from the primary process or as it is recovered after the scavenger step, comprises water, clay and oil. The oil content is, of course, higher in middlings which have not undergone secondary scavenger steps. In the hot water extraction process as mentioned above, waste water streams are removed from the process plant as a slurry of about 35 to 75%, solids by weight. Included in the slurry is sand, silt, clay and small quantities of bitumen.

In this specification, sand is siliceous material which will not pass a 325 mesh screen. Silt will pass 325 mesh and is smaller than 45 microns but is larger than 2 microns. Clay is material smaller than two microns including some siliceous materials of that size.

Because this waste water contains oil emulsions, finely dispersed clay with poor settling characteristics and other contaminents, water pollution considerations prohibit discarding the effluent into rivers, lakes or other natural bodies of water. The disposal of the waste streams has therefore presented a problem.

Currently, waste water is stored in retention ponds which involve large space requirements and the construction of expensive enclosure dikes. A portion of the water in the waste water stream can be recycled back into the hot water extraction process as an economic measure to conserve both heat and water. However, experience has shown that the dispersed silt and clay content of the recycled water can reduce primary froth yield by increasing the viscosity of the middlings layer and retarding the upward settling of oil flecks. When this occurs, the smaller oil flecks and those that are more heavily laden with mineral matter stay suspended in the water of the separation cell and are removed from the cell with the middlings layer.

Waste water streams discharged from the hot water process for extracting bitumen from tar sands often called effluent discharge contain a substantial amount of mineral matter, much of which is colloidally dispersed in the effluent discharge and therefore does not settle very readily when stored in the retention pond. The lower layer of the retention pond can contain up to 50% dispersed mineral matter comprised substantially of clay and silt as well as up to 25% bitumen. This part of the pond water is normally referred to as sludge. Sludge is not suitable for recycling to the hot water extraction process for the reason that its addition into the separation cell or the scavenger cell at the normal inlet means would raise the mineral content of the middlings of the cell to the extend that recovery of bitumen would be substantially reduced. Generally, the settling which does take place in the pond provides a body of water in which the concentration of mineral matter increases substantially from the surface of the pond to the bottom thereof.

A waste water retention pond of the type herein described is normally formed over a reasonably long period of time. A hot water extraction plant for recovering bitumen from tar sands can produce between 12,000 and 25,000 imperial gallons per minute (IGPM) of waste water streams which are stored in the pond. Concurrently, of course, some of the pond water, i.e., that containing less than 5% mineral matter, can be recycled to the hot water extraction process. Recycling pond water serves to reduce the overall volume increase of water stored in the retention pond.

Experience has shown that, as the pond forms, the various components in the effluent discharge settle in the pond at varying rates. As an example, when the waste water containing sand, silt, clay and bitumen is discahrged to the pond, the fee bitumen normally immediately floats to the surface of the pond and the sand immediately settles to the bottom of the pond. However, after the surface bitumen cools and releases the entrapped air which originally caused it to float, it too will begin to settle toward the bottom of the pond. The silt and clay in the discharge settle in the pond at a substantially low rate as compared to the sand.

Thus to characterize a pond, it can be pictured as a large body of water containing dispersed solids which are slowly settling toward the bottom of the pond. The mineral matter in the pond is in a constant but slow state of settling. Normally, the pond is constantly increasing in size because of the continuous addition of waste water and therefore the character of the pond is continually changing.

In processing tar sands to recover butumen therefrom, the tar sands are excavated, extracted to remove the bitumen, whereafter the sand and other minerals are returned to the excavated area. As noted above, waste waters associated with the extraction step must be stored in a retention pond which is normally placed in one of the excavated areas. It is important that the excavated area be filled only with minerals and not with water since obviously the water is excess and therefore requires more storage volume than is available. If a retention pond associated with the hot water extraction of bitumen from tar sands is not treated to remove water layers which cannot normally be reused, such as sludge, the problem of a shortage of storage space is ever present.

As one example, a waste water retention pond associated with hot water process for extracting bitumen from 140,000 to 150,000 tons of tar sands per day and having a surface area of about 1,000 acres and an avarage depth of 40 feet can be characterized somewhat as follows:

a. From the surface of the pond to a depth of about 15 feet the mineral concentration which is primarily clay is found to be about 0.5 to 5.0 weight percent. This pond water can normally be recycled to a hot water extraction process without interfering with the extraction of bitumen from tar sands.

b. The layer of water in the pond between 15 and 25 feet from the surface contains between 5.0 and 20% mineral matter. This water, if recycled to the separation cell feed with fresh tar sands, would increase the mineral content of the middlings portion of the cell to the point that little bitumen would be recovered.

c. Finally, the section of the pond between 25 feet and the bottom of the pond contains 20 to 50% mineral matter and is normally referred to as sludge.

Many procedures for treating waste waters associated with the extraction of bitumen from tar sands have been proposed. For example, Canadian Pat. No. 841,582 issued May 12, 1970 to R. A. Baillie claims a method for recovering additional bitumen from waste water streams recovered from a tar sands hot water extraction process comprising settling the stream and removing floating bitumen from the surface thereof.

Canadian Pat. No. 824,968 issued Oct. 14, 1969 to Robert A. Baillie discloses a treatment of waste water from a hot water extraction process which comprises percolating the waste water through an inclined sand pile to incorporate the clay and silt of the waste water into the interstices of the sand pile.

Canadian Pat. No. 866,266 issued Mar. 16, 1971 to Raymond et al. discloses removing bitumen from waste water streams by incorporating viable microorganisms therein which subsequently results in clay settling. Canadian Pat. Nos. 873,317 issued June 16, 1971 to Baillie et al.; 873,318 issued June 16, 1971 to Baillie et al.; 873,853 issued June 22, 1971 to Baillie et al.; 874,418 issued June 29, 1971 to Camp; 874,419 issued June 29, 1971 to Steinmetz, 878,656 issued Aug. 17, 1971 to Seitzer et al.; 882,668 issued Oct. 5, 1971 to Camp; 890,804 issued Jan. 18, 1972 to Fear et al.; 891,472 issued Jan. 25, 1972 to Camp; 892,548 issued Feb. 8, 1972 to Hepp et al. and 917,586 issued Dec. 26, 1972 to Paulson each disclose methods for treating waste water streams associated with the hot water method for extracting bitumen from tar sands. Yet none of these proposals provides an economically attractive process for treating hot water extraction process waste waters associated with the recovery of bitumen from tar sands. By the method of the present invention an improved process for resolving this problem is provided.

DESCRIPTION OF THE INVENTION

The present invention provides a process for treating retention pond sludge containing at least 20% solids and associated with the hot water extraction of bitumen from tar sands.

Specifically, the present invention provides a method whereby mineral matter and bitumen can be removed from sludge material to provide an aqueous stream substantially reduced in mineral matter and bitumen and which can be processed for reuse in the hot water extraction of bitumen from tar sands.

More specifically, the present invention comprises withdrawing a sludge material containing at least 20 weight percent solids from a retention pond and agitating the sludge material with additional water containing less than 6% solids to provide a diluted sludge final composition having 6 to 18 weight percent dispersed solids therein. The diluted sludge is thereafter settled to provide a lower layer containing a concentration of solids therein greater than that of the undiluted sludge; a middle layer containing a lower quantity of solids than the diluted sludge; and an upper layer comprised of bituminous froth.

For the purposes of the present description, bitumen found in pond water is included as a part of the solids of that stream. Also, the term bitumen as used includes any hydrocarbon material, liquid or solid, which is generally found in a waste water retention pond such as that herein described.

The lower layer from this settling step can thereafter be withdrawn and treated to remove the mineral matter and other solids from the water by procedures such as by evaporation and consolidation and other similar means. The bitumen floating on the upper layer of the settling zone can be recovered for use in the production of synthetic crude. Finally, the aqueous middle layer of this settling zone can be stored in a separate storage zone or can optionally be returned to a retention pond such as the pond from which it was originally withdrawn for further settling to provide a supernatant layer of reduced solids suitable for use in the hot water extraction of bitumen from tar sands.

As a typical example, a retention pond of the type defined above associated with the hot water extraction process suitable for processing approximately 140,000 to 150,000 tons of tar sands a day could provide enough sludge material to operate the process of this invention at the rate of about 9,000 to 15,000 IGPM on a continuous basis. In processing this quantity of sludge, feed rates could be maintained at about 3,000 to 5,000 IGPM of high solids sludge combined with about 6,000 to about 10,000 IGPM of low solids pond water.

As one means of further defining one mode of the process of the present invention, the following example in relation to the FIGURE in the drawing attached hereto is provided. Referring to the FIGURE, sludge material from area 3 in retention pond 1 as defined by dike walls 21 and 22 is characterized as containing about 4.4% bitumen, 1.0% sand, 17.7% silt, 7.8% clay and 69.1% water. Upper layer 4 of the pond is characterized as containing 0.3% bitumen, 0.3% silt, 2.8% clay and 96.6% water. Middle layer 2 of pond 1 contains between 6 and 20% solids. Sludge from layer 3 which contains 20% or more of solids is withdrawn via pump 6 which is situated on flotation means 5 on the surface of pond 1. This sludge is transferred via line 9 into line 10 at a rate of about 3,200 IGPM where it is combined with pond water 4 which is recovered via pump 7 through line 8 at the rate of about 7,700 IGPM. The combined streams in line 10 are transferred at about 10,900 IGPM to sludge treating zone 11 as shown in the FIGURE. In this treating zone the diluted sludge can be optionally subject to additional agitation and also optionally subject to air injection. Floating bitumen which is often found in this zone can optionally be recovered via line 12 for further processing by means not shown. The diluted sludge stream from treatment zone 11 is withdrawn via line 13 and transferred into settling cell 14 for further processing. The diluted, treated sludge stream transferred via line 13 from treating zone 11 can be characterized as containing about 1.6% bitumen, 0.3% sand, 6.0% silt, 4.5% clay and about 87.7% water.

In settling cell 14 the diluted, sludge material is permitted to settle for a period of about 48 hours. In the settling zone upper layer 20 comprised of floating bituminous froth and middle layer 15 comprised substantially of water containing a lower solids concentration than sludge is formed. Also, a lower layer 16 which is comprised of water containing a higher solids concentration than the sludge is also formed.

The lower layer 16 of settling zone 14 is withdrawn at the rate of about 800 IGPM via line 17 and sent to a zone not shown wherein the concentrated sludge is further treated to remove the solid matter from the water contained therein. The sludge layer recovered via line 17 can be characterized as containing about 1.0% bitumen, about 4.0% sand, about 49.0% silt, about 3.0% clay and 43.0% water, comprising approximately 57.0% solids in water. The bitumen layer in settling zone 14 as indicated by numeral 20 can be recovered via recovery means 19 at the rate of about 400 IGPM. This bituminous layer can be characterized as containing about 34.2% bitumen, 2.6% clay, and 63.2% water.

The middle layer in settling zone 14 which is indicated by numeral 15 can be recovered from settling zone 14 at the rate of about 9,700 IGPM via line 18 and returned to retention pond 1. Typically, this layer from settling zone 14 can be characterized as containing 0.5% bitumen, about 2.0% silt, about 4.2% clay and 92.8% water. Thus this stream being returned to the pond contains less than 8% mineral matter, which upon further settling can be suitable for use as a feed water stream to the hot water extraction process.

In practicing this invention, an important feature is that the pond sludge be diluted. Agitation and/or aeration are beneficial and essential to the extent that proper mixing is achieved. Although the theory on which the process operates is not clearly understood, it is believed that the dilution step upsets the sludge, so that the gel like structure set up by the fine clay particles in the minerals settle more easily and bitumen floats more easily. Aeration, when used, should be sufficient to mildly agitate the sludge stream being treated. Settling time in the settling zone can be in the range of 0.1 to 100 hours based on the requirement of the stream being treated. Preferably, the ratio of diluent to sludge is in the range of 0.0 to 10 parts diluent per part of sludge. Diluent ratios, of course, are dictated in part by the solids concentrations in both the diluent and sludge feeds.

By the sludge treating process of the present invention, it is possible to remove dispersed solids from the pond in the form of sludge at about the same rate as the sludge layer is being formed in the pond. Also, this method provides a means for recovering bitumen from sludge which provides an additional economic incentive to the process.

Sludge material treated in the process of the invention should contain at least 20 weight percent solids and should be diluted to a range of 6 to 18 weight percent solids prior to agitation and settling. In the present specification all parts and percentages are by weight unless otherwise stated.

Thus the present invention provides a method for reducing the mineral and bitumen content of a retention pond associated with hot water extraction of bitumen from tar sands containing a sludge layer comprised of 20 to 50% solids in water including mineral matter and 0.5 to 25.0% bitumen comprising:

a. withdrawing the sludge from said retention pond;

b. agitating said sludge with water to provide a sludge stream containing 6 to 18% solids;

c. settling said agitated sludge to form an upper layer of bituminous froth, a middle layer comprised of water having a substantially lower solids content than said undiluted sludge, and a lower layer containing a substantially higher solids content than said undiluted sludge; and d. recovering said upper layer.

The invention claimed is:

1. A method for treating the sludge layer of a retention pond associated with the hot water extraction of bitumen from tar sands said sludge layer containing 20 to 50% solids including 0.5 to 25.0% bitumen comprising:

a. withdrawing said sludge from the retention pond;

b. diluting and mixing said sludge with additional water to provide a sludge stream containing 6 to 18% solids;

c. settling said diluted sludge to form an upper layer of bituminous froth, a middle layer comprised of water having a substantially lower solids content than said sludge, and a lower layer containing a substantially higher solids content than said sludge;

d. recovering said middle layer, and e. recovering said lower layer.

2. A method according to claim 1 wherein said bitumen layer is recovered.

3. A method according to claim 1 wherein the middle layer formed in step (c) is returned to said retention pond.

4. A method according to claim 1 wherein the mixing of said sludge with additional water in step (b) is promoted by agitating the mixture.

* * * * *